United States Patent [19]

Waggott et al.

[11] Patent Number: 4,891,484

[45] Date of Patent: Jan. 2, 1990

[54] VARIABLE WIDTH APPARATUS FOR INDUCTION HEATING OF MOVING WORKPIECES

[75] Inventors: Ralph Waggott, Great Mollington; Robert C. J. Ireson, Bournemouth, both of United Kingdom

[73] Assignees: The Electricity Council, London; Davy (Poole) Limited McKee, Poole, both of England

[21] Appl. No.: 242,301

[22] Filed: Sep. 9, 1988

[30] Foreign Application Priority Data

Sep. 15, 1987 [GB] United Kingdom ..... 8721663

[51] Int. Cl.[4] ..... H05B 6/40

[52] U.S. Cl. ..... 219/10.61 R; 219/10.71; 219/10.75; 219/10.79

[58] Field of Search ..... 219/10.71, 10.69, 10.61 R, 219/10.79, 10.75, 10.4, 91

[56] References Cited

U.S. PATENT DOCUMENTS

| | | | |
|---|---|---|---|
| 2,419,116 | 4/1947 | Cassen et al. | 219/10.79 X |
| 2,448,009 | 8/1948 | Baker | 219/10.79 |
| 3,444,346 | 5/1969 | Russell et al. | 219/10.61 R |
| 4,258,241 | 3/1981 | Soworowski | 219/10.71 |

*Primary Examiner*—Philip H. Leung

*Attorney, Agent, or Firm*—Beveridge, DeGrandi & Weilacher

[57] ABSTRACT

The apparatus comprises a pair of opposed coil assemblies between which a workpiece to be heated is moved, each coil assembly including a plurality of loop windings arranged generally in a plane parallel to the plane of movement of the workpiece between the coil assemblies, the windings being arranged in pairs with the windings in each pair being aligned transversely in the direction of movement of the workpiece, adjacent end portions of the windings of each pair being turned to extend substantially perpendicularly to the plane of the remainder of the windings and away from the plane of movement of the workpiece. The arrangement allows the width of the coil assemblies to be altered in dependence upon the width of a workpiece to be heated.

6 Claims, 4 Drawing Sheets

VARIABLE WIDTH APPARATUS FOR INDUCTION HEATING OF MOVING WORKPIECES

BACKGROUND

This invention relates to induction heating apparatus, and particularly to such apparatus comprising a pair of opposed coil assemblies between which a workpiece to be heated is moved.

With such apparatus the workpiece, for example a metal strip, is heated by the currents induced therein by the passage of electric currents through the windings of the coil assemblies.

A difficulty which arises with such apparatus is the obtaining of a required temperature profile, for example a uniform temperature, across the width of the workpiece, the width being the dimension of the workpiece perpendicular to the direction of movement of the workpiece between the coil assemblies.

Various ways of meeting this difficulty have been proposed, including particular arrangements of the windings in the coil assemblies, and/or suitable control of the currents supplied to the windings.

A further difficulty which arises is providing an apparatus which can provide a required temperature profile across the width of any workpiece having a width within a predetermined range of widths.

SUMMARY OF THE INVENTION

According to this invention there is provided induction heating apparatus comprising a pair of opposed coil assemblies between which a workpiece to be heated is moved, wherein each coil assembly includes a plurality of loop windings arranged generally in a plane parallel to the plane of movement of the workpiece between the coil assemblies, the windings being arranged in pairs with the windings in each pair being aligned transversely of the direction of movement of the workpiece, adjacent end portions of the windings of each pair being turned to extend substantially perpendicularly to the plane of the remainder of the windings and away from the plane of movement of the workpiece.

Each coil assembly can include a plurality of loop windings arranged generally in a plane parallel to the plane of movement of the workpiece, the windings being arranged in groups with the windings in each group being aligned transversely of the direction of movement of the workpiece, adjacent end portions of the windings in each group being turned to extend substantially perpendicularly to the plane of the remainder of the windings and away from the plane of movement of the workpiece.

Adjacent turned end portions of the windings of each pair or group can abut each other. Otherwise adjacent turned end portions of the windings of each pair or group can be separated by passive spacer members which serve to distribute the flux generated by the associated windings, With the apparatus of this invention the overall width of the coil assemblies can be readily altered as necessary in dependence upon the width of a workpiece to be heated.

BRIEF DESCRIPTION OF THE DRAWINGS

This invention will now be described by way of example with reference to the drawings, in which.

DETAILED DESCRIPTION

The apparatus to be described is for use in induction heating a workpiece in the form of a strip of metal. Such apparatus is generally well known, and the general construction and theory of operation of such apparatus will not therefore be described in detail herein.

Figure 1:
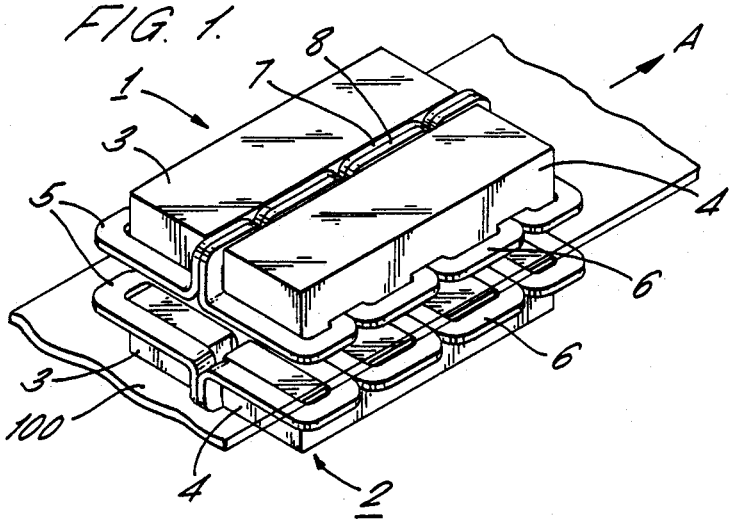
FIG. 1 is a diagrammatic perspective view of an apparatus according to the invention.
Figure 2:
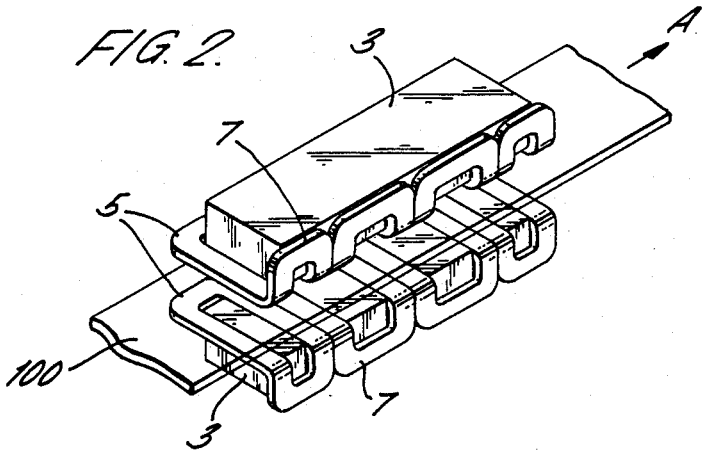
FIG. 2 is a perspective view of part of the apparatus of FIG. 1.

Referring to FIGS. 1 and 2 of the drawings, the apparatus here shown comprises a pair of opposed coil assemblies 1 and 2 between which the workpiece 100 to be heated is passed longitudinally. Each coil assembly 1 or 2 comprises a pair of core members 3 and 4 each carrying a plurality of loop windings 5 or 6 arranged generally in a plane parallel to the plane of movement of the workpiece 100 between the coil assemblies 1 and 2. The windings in each coil assembly 1 or 2 are arranged in pairs, each pair consisting of a coil 5 on the core 3 and a coil 6 on the core 4, and the windings 5 and 6 in each pair being aligned transversely of the direction of movement (arrow A) of the workpiece 100 between the coil assemblies 1 and 2.

Adjacent end portions 7 and 8 of the windings 5 and 6 of each pair are turned to extend substantially perpendicularly to the plane of the remainder of the windings end away from the plane of movement of the workpiece 100, adjacent turned end portions 7 and 8 of the windings 5 and 6 of each pair abutting each other.

The apparatus shown in FIGS. 1 and 2 is used for heating a workpiece of a certain width, and basically a width corresponding to the width of the coil assemblies 1 and 2. If a wider strip is to be heated, then apparatus as shown in FIGS. 3 and 4 can be used.

Figure 3:
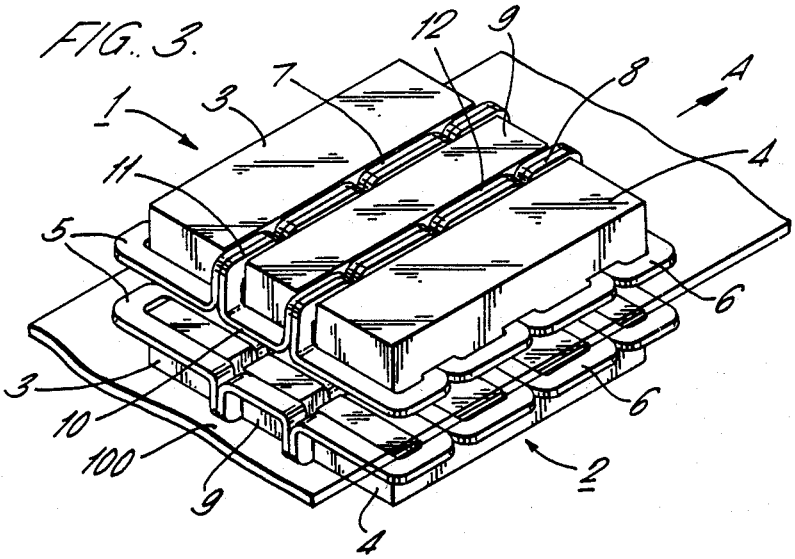
FIG. 3 is a diagrammatic perspective view of another apparatus according to the invention.
Figure 4:
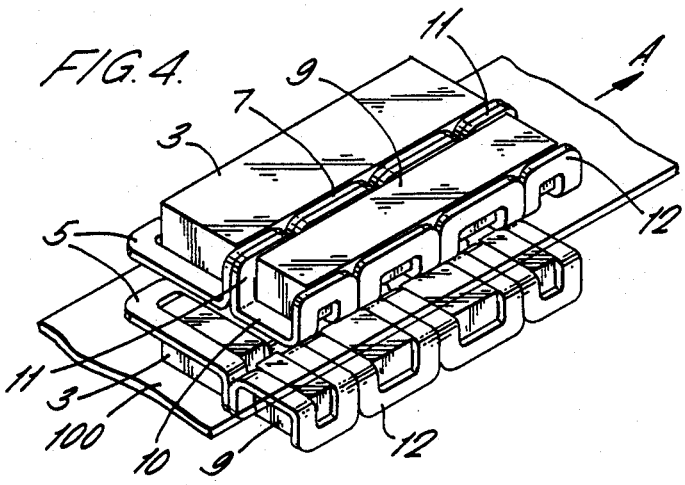
FIG. 4 is a perspective view of part of the apparatus of FIG. 3.

In FIGS. 3 and 4 parts of the apparatus shown corresponding to parts of the apparatus of FIGS. 1 and 2 have the same references.

In the apparatus of FIGS. 3 and 4 the coil assemblies 1 and 2 each include a third core member 9 located between the core members 3 and 4, and carrying windings 10 having portions 11 and 12 at both ends turned to extend substantially perpendicularly to the plane of the remainder of the windings and away from the plane of movement of the workpiece 100. The windings 10 on the cores 9 are aligned with windings 5 and 6 on th associated cores 3 and 4, the windings thus being in groups of three (5, 10, 6) with each coil assembly 1 or 2 consisting of a group of three core members (3, 9, 4).

Adjacent turned end portions 7, 11, and 12, 8 of the windings 5, 10, 6 in each group abut each other.

It will be appreciated that further intermediate core members carrying windings with turned end portions can be added to the apparatus of FIGS. 3 and 4 to give coil assembles 1 and 2 for heating workpieces of even greater width.

Figure 5:
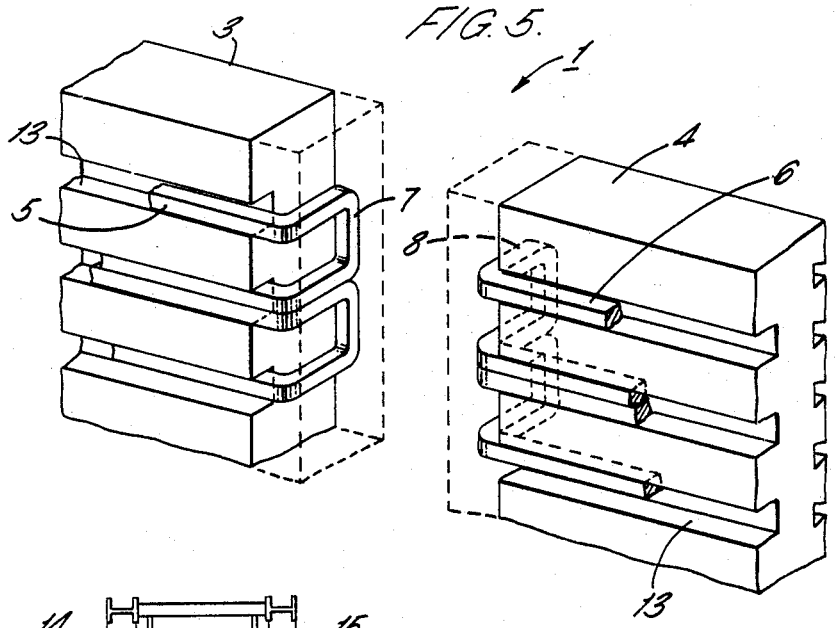
FIG. 5 is a diagrammatic perspective view illustrating the construction of apparatus as shown in FIGS. 1 to 4.

Referring to FIG. 5, this shows the construction of a coil assembly, say 1, the core members 3 and 4 being formed with grooves 13 which receive the windings 5 and 6. The core members 3 and 4 will generally be of known laminated form.

Although in the apparatus of FIGS. 1 to 4 the adjacent turned end portions of the windings of each pair or group abut, they can otherwise be separated by passive spacer members of magnetic material, to be described in more detail later, which serve to distribute the flux generated by the associated windings, and FIG. 5 shows the adjacent turned end portions 7 and 8 separated by a gap to receive such spacer members.

Figure 6:
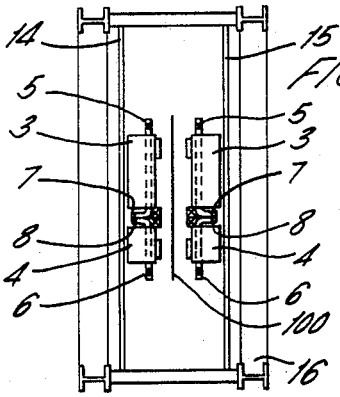
FIG. 6 is an end view of an apparatus including apparatus as shown in FIGS. 1 and 2.

Referring now to FIG. 6, this shows apparatus as shown in FIG. 1 with the coil assemblies 1 and 2 mounted on respective rails 14 and 15 within a frame work 16, the core members 3 and 4 of each assembly 1 or 2 being movable along the associated rail 14 of 15 relative to each other to vary the spacing between the core members 3 and 4 and permit the introduction of further core members (such as 9 in FIGS. 3 and 4) or spacer members, to modify the apparatus for use with a workpiece 100 of a particular width.

Figure 7:
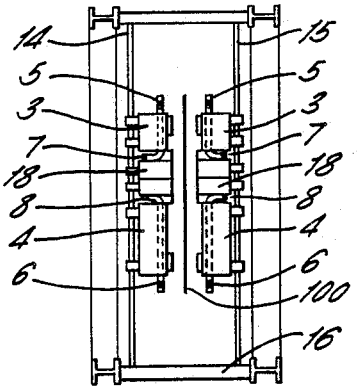
FIG. 7 is an end view of another apparatus including apparatus as shown in FIGS. 1 and 2.

Referring now to FIG. 7, this shows an arrangement as shown in FIG. 6, but with the core members 3 and 4 of each coil assembly 1 or 2 separated by interposed spacer members 18 of magnetic material the apparatus thus heating a workpiece 100 wider than that heated by the apparatus as shown in FIG. 6.

Figure 8:
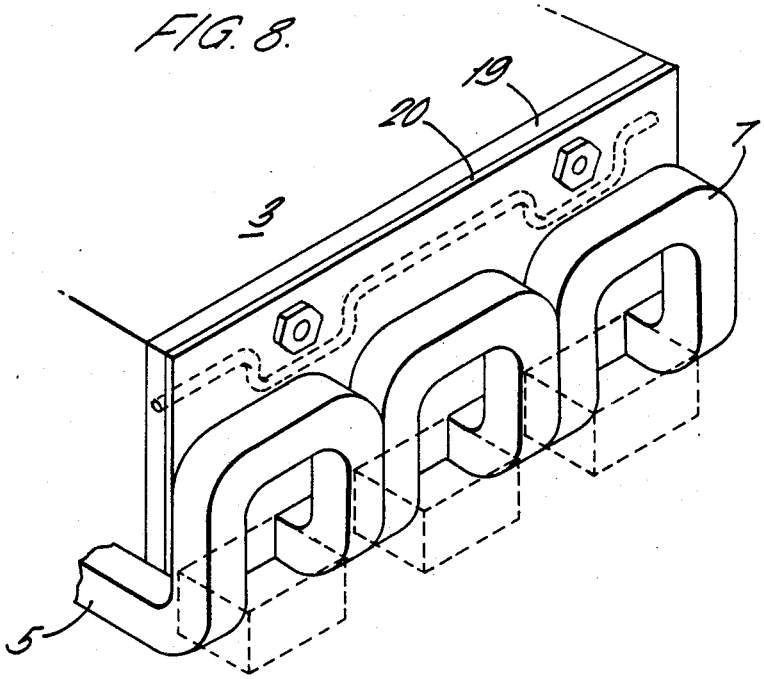
FIG. 8 is a perspective view of a detail of a modified form of apparatus as shown in FIGS. 1 to 4.

Referring now to FIG. 8, this shows a construction of core member 3 and windings 5 with turned end portions 7, in which the core member 3 is a laminated structure having a clamping plate 19 at its edge and serving to retain the laminations together, and a copper flux screening plate 20 arranged between the clamping plate 19 and the turned end portions 7 of the windings 5. The clamping plate 18 and/or the screening plate 20 contain channels 21 for the passage of cooling water therethrough. It will be appreciated that such a construction can be used for any of the core member/winding arrangements shown in FIGS. 1 to 7.

Figure 9:
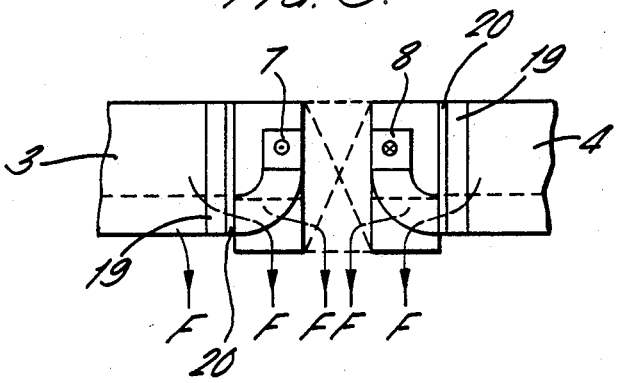
FIG. 9 is a diagram illustrating operation of apparatus in accordance with the invention.

FIG. 9 illustrates the paths F of flux in the apparatus of FIG. 8.

Figure 10:
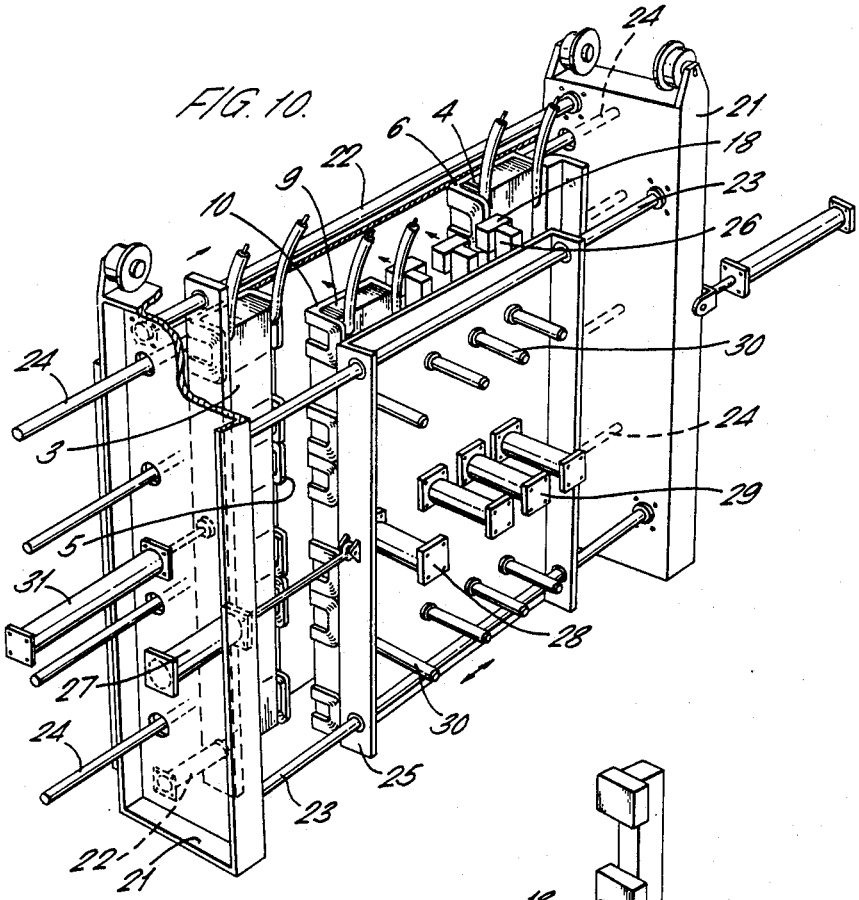
FIG. 10 is a perspective view of a substantially complete apparatus according to the invention.
Figure 11:
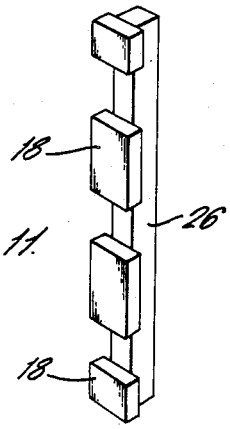
FIG. 11 is a perspective view of a part of the apparatus of FIG. 10.

Referring now to FIGS. 10 and 11, the apparatus here shown comprises a frame having a pair of side members 21 held in spaced relationship by two pairs of rails 22 and 23. Mounted on the rails 22 are a pair of core members 3 and 4 carrying windings 5 and 6 which form part of a coil assembly as shown in FIGS. 3 and 4, the core member 3 being capable of movement towards and away from the core member 4 between the side members 21. The core member 3 is movable along the rails 22 by means of a ram 31 mounted on the adjacent side member 21. Control rods 24 which extend out through holes in the side members 21 of the frame, are used to control flux modifiers (not shown) carried by the core members 3 and 4.

Mounted on the rails 23 is a carrier 25 on which are mounted a core member 9 carrying windings 10 forming the central part of the coil assembly as shown in FIGS. 3 and 4. Also mounted on the carrier 25 are three bars 26 each carrying a plurality of magnetic spacer members 18, as clearly shown in FIG. 11. The carrier 25 is movable along the rails 23 by means of a ram 27 mounted on one of the side members 21 of the frame, while the core member 9 and the spacer member bars 26 are movable relative to the carrier 25 and perpendicular to its direction of movement along the rails 23, by means of individual rams 28 or 29 mounted on the carrier 25. By operation of the rams 28 and 29 the core member 9 and spacer member bars 26 can be positioned in line with and between the core members 3 and 4 and withdrawn from such a position as required, being guided by bars 30 whcih extend through holes in the carrier 25.

For use of the apparatus as a coil assembly 1 or 2 as shown in FIGS. 3, 4, 6 and 7, in dependence upon the width of the workpiece to be heated the core member 9 and one or more of the spacer member bars 26, as required, are advanced from the carrier 25 by means of the rams 28 and 29, to be positioned between the core members 3 and 4. The core member 3 is then closed towards the core member 4 to sandwich any advanced core member 9 or spacer members 18 therebetween, the position of the carrier 25 between the side members 21 of the frame being adjusted as necessary by means of the ram 27. It will be appreciated that if none of the core member 9 and spacer member bars 26 is advanced, then the core member 3 will be closed into contact with the core member 4 to give a coil assembly as shown in FIGS. 1 and 2.

Thus, two apparatus as shown in FIG. 10 can be used as the coil assemblies of an induction heating apparatus as previously described with reference to FIGS. 1 to 9, to heat workpieces having widths within a relatively wide range.

What is claimed is:

1. Induction heating apparatus comprising a pair of opposed coil assemblies between which a workpiece to be heated is moved, wherein each of said coil assemblies includes a plurality of loop windings arranged generally in a plane parallel to the plane of movement of the workpiece between said coil assemblies, said windings being arranged in groups with the windings in each of said groups being aligned transversely of the direction of movement of the workpiece, said windings of each of said groups having turned end portions that extend substantially perpendicularly to the plane of the remainder of said windings and away from the plane of movement of the workpiece, core members carrying said windings, each of said core members carrying a plurality of said windings aligned in the direction of movement of the workpiece, said core members of each of said coil assemblies being mounted for movement relative to each other in a direction transverse to the direction of movement of the workpiece to vary the spacing between said turned end portions of adjacent said windings, said adjacent turned end portions of said windings of each of said groups being separated by passive spacer members of magnetically permeable material which serve to maintain the flux pattern generated by associated said windings.

2. Apparatus as claimed in claim 1, wherein said core members are mounted on rails along which they can be moved.

3. Apparatus as claimed in claim 1, wherein said spacer members are mounted on rails along which they can be moved.

4. Apparatus as claimed in claim 1, wherein each of said groups of windings has only two said core members.

5. Apparatus as claimed in calim 1, wherein each of said groups of windings comprises three or more of said core members, intermediate said windings of each of said groups being carried by cores mounted for movement in a direction perpendicular to the plane of movement of the workpiece.

6. Apparatus as claimed in claim 1, wherein said spacer members are mounted for movement in a direction perpendicular to the plane of movement of the workpiece.

* * * * *